United States Patent [19]

Lavoisey et al.

[11] 4,270,682

[45] Jun. 2, 1981

[54] SHEET RUPTURING

[75] Inventors: Yves Lavoisey, Asnieres; Jean Nierlich, Antony, both of France

[73] Assignee: Saint-Gobain Industries, Neuilly-sur-Seine, France

[21] Appl. No.: 36,654

[22] Filed: May 7, 1979

[30] Foreign Application Priority Data

May 12, 1978 [FR] France ..... 78 14142

[51] Int. Cl.[3] ..... B26F 3/06

[52] U.S. Cl. ..... 225/1; 225/2; 225/93.5

[58] Field of Search ..... 225/93.5, 1; 83/16, 83/171

[56] References Cited

U.S. PATENT DOCUMENTS

| | | | |
|---|---|---|---|
| 2,293,178 | 8/1942 | Stocker | 83/16 |
| 2,524,584 | 10/1950 | Zehr | 156/204 |
| 2,982,456 | 5/1961 | Hsu et al. | 225/2 |
| 2,994,108 | 8/1961 | Bjorksten | 264/504 |
| 3,739,963 | 6/1973 | Michalik | 83/16 X |
| 3,750,504 | 8/1973 | Sidler | 83/16 |
| 3,782,615 | 1/1974 | Webster et al. | 225/93.5 X |
| 4,014,229 | 3/1977 | Lynch | 83/16 |

FOREIGN PATENT DOCUMENTS 7530232 4/1976 France .

*Primary Examiner*—Frank T. Yost

*Attorney, Agent, or Firm*—John T. Synnestvedt; Richard D. Weber

[57] ABSTRACT

A cutter and cutting method for cutting synthetic resin sheets or ribbons in a manner that avoids the formation of particulates from the cutting operation are disclosed. The cutter includes a blade and associated sheet holding structure for creating a sharp bend in the sheet. The sharp bend creates a zone of high stress in the sheet. An element for rapidly heating the sheet is brought near the edge of the blade where the fold in the sheet exists. The localized stress in the fold cause the sheet to rupture along the fold after the sheet has been heated to a sufficient extent.

23 Claims, 7 Drawing Figures

SHEET RUPTURING

FIELD OF THE INVENTION

The present invention relates to cutting sheets or films formed from one or several layers of plastic material, especially to the cutting of transparent of translucent sheets having good optical properties and that are suitable for use in the manufacture of laminated glazings. The invention concerns more particularly a new process and a new device for cutting sufficiently soft and flexible sheets of thermosetting and/or thermoplastic materials for example polyurethanes, polyethylenes, polyvinylbutryal, copolymers, etc. The invention is preferably applied to cutting thermosetting sheets or films, possibly coated with a thin thermoplastic layer.

BACKGROUND OF THE INVENTION

The sheets of plastic material, especially those utilized in the manufacture of laminated glazings, are generally stored after manufacture in the form of rolls and are cut in a first cutting operation at dimensions slightly larger than those of the laminated glazing, just before assembly of the components of the glazing. The final trimming, to the configuration of the glazing, is made generally after assembly of the components.

Several means are known for effecting the first cutting. For example one can utilize the mechanical action of a cutting blade such as a razor blade or a knife. One can also cut certain sheets of plastic material by the action of heat. Thus, it is known to cut polyethylene sheets by contact with a heated resistor. To aid in the cleanness of the cut, it is also known to combine a mechanical action with a thermal action, for example by utilizing a cutting tool with a hot blade. Another method of cutting sheets of plastic material involves utilizing the combined action of a cutting tool with ultrasound which facilitates the penetration of the tool into the sheet.

All of the previously cited methods for cutting have different disadvantages. Some soil the sheet being cut; others rapidly age the cutting tool and/or also promote emission of toxic gases.

Thus a cutting tool with a cold blade can promote shavings and shreddings that can settle on the sheet, while contact with a heated resistor or with a heated blade can cause, for example in the case of a polyurethane sheet, carbon deposits on the heated element. The carbon can be deposited on the sheet during a subsequent cutting. However, when the sheet to be cut is transparent or translucent and is utilized in the manufacture of laminated glazings, the particles, especially the shavings and the carbon present on the surface of the sheet and which cannot be buried in the thickness of the latter after its assembly with the other components of the glazing, can cause optical defects in the form of, for example, distortions and/or lense-like distortions. It is therefore necessary to avoid having particulates present during the preparation of the glazing and, in this case, during the cutting of the sheet.

The carbon, as well as the great resistance of certain plastic materials to cutting, especially thermosetting polyurethanes, rapidly age cutting tools which after only ten cutting operations or so must be replaced or resharpened. Frequent changing of the tools influences not only the output and the cutting cadence, but also involves soiling the cutting area by bringing to it, in this case, dust resulting from human intervention.

In addition, when cutting a sheet of polyurethane, contact of the heated blade with the polyrurethane can generate toxic vapors. These vapors can also condense and settle on the neighboring elements of the sheet, which leads to further risks of soiling the sheet.

SUMMARY OF THE INVENTION

The applicants propose a new cutting process for sheets of plastic material enabling improvement of the quality of the cut, by obviating the abovementioned defects, particularly the formation of particles during the cutting operation. Furthermore, the new process makes cleaning of the sheet after cutting unnecessary.

According to the invention, a stress zone is created on the sheet to be cut by elongation, confined in the form of a stress line, by acting on areas of the sheet beyond this line. The stress line is heated without contact, which has the effect of rupturing the sheet along this line.

The heating of the sheet of plastic material causes changes in the mechanical properties of the sheet, particularly a diminution of its mechanical properties such as the elongation and/or strength at rupture. The rupture of the sheet can occur at a temperature of, for example, on the order of 100° C.

The cutting is thus much neater because the stress zone is better confined, and that is why it is preferable to create these stresses by bending the sheet.

Advantageously, maximum stress is exerted on the sheet by bending the sheet at an angle of 180°. When the sheet of plastic material is a composite sheet formed from two or several layers of thermosetting plastic or thermoplastic material, it is preferable to impart greater stress on the layer of plastic material which possesses the higher mechanical characteristics of elongation and/or strength at rupture. In this way, the heating and/or the elongation efforts to be applied to the sheet, necessary for the rupture of the latter, can be lessened thereby producing a more rapid cutting.

For example, in order to cut a composite sheet formed essentially from two layers of different polyurethanes (such a sheet is described in the Belgian patent application No. 77 20414—namely first, a layer of thermosetting polyurethane having excellent self-healing properties; that is to say on the surface of which accidental scratches or local compressions rapidly disappear, the sheet having, as well, antilacerative properties—that is to say that a polyurethane of this type, utilized in a laminated glazing, resists tearing during an accidental breaking of the glazing and retains the live splinters of glass, thus protecting the occupants of the vehicle from cuts and injuries from the glass—, the second layer being a thermoplastic polyurethane capable of adhering to a monolithic or laminated support, made of glass or plastic material) it is preferable to place the layer of thermoplastic polyurethane, having approximately 600% elongation at rupture that is higher than that of the thermosetting polyurethane, which is about 100 to 150% elongation at rupture, at the exterior of the fold of the sheet. In this way greater stress is imparted on the layer of plastic material which has the highest elongation at rupture. As noted before, this eases the cutting of the sheet.

Heating without contact of the stress zone is concentrated on said zone. It is generally effected by radiation and must be powerful and instantaneous. One can also use high frequency heating by creating, in the known way, an electrical field between two electrodes. Heating of the stress zone by concentrated blowing of hot air or inert hot gas on the plastic material can also be used, by taking certain precautions so as to avoid introducing dust through the system supplying the hot gas, which would risk soiling the sheet.

Preferably, the stress line is without contact with not only the heating element but also at the time of the cutting, it is without contact with all other elements and particularly with those providing the stress. In this way, all risk of soiling by these elements is avoided.

The cutting of the sheet can be done simultaneously at all points of the cutting line by applying a uniform heat on this line. One can also, to obtain a perfectly rectilinear cut, begin the rupture at one side of the sheet, this rupture then propagating across the entire width.

When the sheet to be cut is derived from a continuous ribbon of plastic material obtained by casting onto a bed formed of a series of glass plates, as described in the French patent application No. 76 18543, the ribbon often has different thicknesses at the portions of the ribbon that were disposed at the joints between successive glass plates; this can subsequently promote optical defects, after assembly with the support, in the form of distortions, for example, when utilizing this part of the sheet in a laminated glazing. That is why it is often necessary to eliminate the portion of the ribbon corresponding to the abovementioned joints, by cutting on both sides of the joint. This is also the case when the sheet to be cut is made up of a series of sheets of the same length, joined together by an adhesive ribbon, for example, to enable the continuous cleaning of the sheets and/or to facilitate their transport. It is beneficial, from the standpoint of cutting rate, to cut on two sides of the joint simultaneously. The simultaneous double cutting at distances on the order of 200 millimeters yields another advantage as compared to an isolated cut; each of the two cuts favors the other by increasing the stress in the two cutting zones. A number of simultaneous cuts greater than two is also obtainable.

The cutting process in accordance with the invention produces a clean cut without the formation of any shavings or particles. The cut sheet can therefore be utilized for the manufacture of laminated glazings without cleaning the sheet subsequent to the cutting.

The cutting process of the invention is applicable not only to intermittant cutting of sheets, but it also concerns, the continuous cutting of sheets of plastic material. Thus, in the example already cited, in obtaining sheets of plastic material from a continuous ribbon obtained by flowing material onto a movable bed, it is often necessary to eliminate the edges of the ribbon which generally have inadequate optical qualities. To cut these edges, one can advantageously proceed according to the invention by creating stress on the ribbon in a continuous fashion along two stress lines, then pass the two stress lines in front of heating elements to obtain rupture. One can also proceed in this way in order to cut the ribbon into several bands of equal or different widths.

The invention also concerns a new device for cutting the sheets or films comprising one or several layers of thermosetting plastic and/or thermoplastic material.

The device proposed by the Applicants has a support for the sheet, said support being separated lengthwise into two parts by a thin rigid blade, means for creating stress on a limited zone of the sheet by folding the sheet around the rigid blade, and heating means facing the fold that is formed to heat the fold.

The means for folding the sheet can comprise two clamps that act on the sheet holding the sheet around both sides of the blade to form the fold. The two clamps can be mounted rigidly and joined together. Their operative sides are thus spaced at a fixed distance apart, equal to or slightly greater than the sum of the thickness of the blade and twice the thickness of the sheet.

In the abovementioned simplified mode of the device, the fixed distance between the two clamps limits the application of this device to the cutting of sheets that are of relatively equal thickness. The action of the clamps on the sheet is made, in this mode, by advancing the clamps to the blade. It is necessary to regulate the position and the displacement of the elements of the device in a precise way with respect to each other. When the thicknesses of the sheets are different, a similar device has to be used with clamps having a different spacing. This is why, advantageously, the device comprises adjustable clamps.

Preferably, the device is made with two clamps that approach each other at the same time that they form the fold of the sheet around the blade. Friction against the sheet is, therefore, limited.

When the stress lines are made, for example by folding, the fold line generally has no contact with the blade around which the folding is effected.

Means for heating the fold formed on the sheet by the squeezing action of the clamps can consist of a high-frequency heating device comprising two electrodes that can be located one above the fold, the other located beneath the fold, in a way that an electrical field is created between the two electrodes at the level of the fold; the electrode beneath the fold may be the rigid blade itself which is, consequently, a metal blade.

To simplify the device, the heating means advantageously comprises a heated resistor supplied preferably with a low voltage, high amperage electrical current, in order to obtain a quasi-instantaneous heating. The resistor is situated facing the fold of the sheet and at a short distance, for example, on the order of 1 mm. Heating of the fold is accomplished by radiation.

Other characteristics and advantages of the invention will become evident in the description, made referring to the figures, of several examples of the device.

DESCRIPTION OF THE PREFERRED EMBODIMENT

Figure 1:
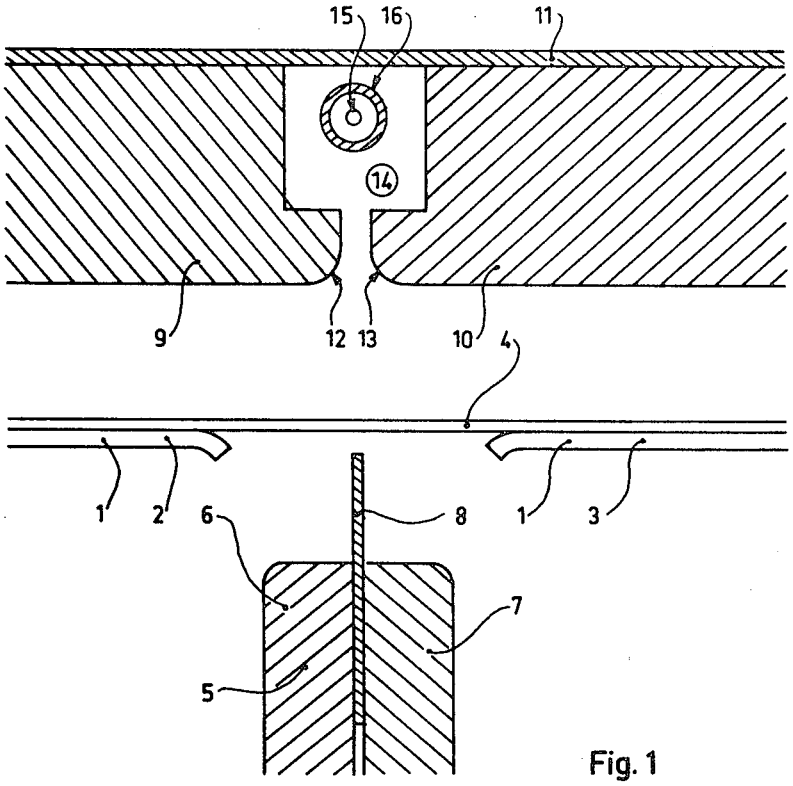
FIG. 1 shows an embodiment of the device in the rest position prior to cutting, in a section perpendicular to the cutting line.

FIG. 1 shows, in the rest position prior to cutting, an embodiment of the device in a sectional view perpendicular to the cutting line. The support 1 has two parts 2 and 3 that support the sheet 4 which has a thickness of about 0.5 mm. When the cut sheet is used ultimately for the manufacture of a laminated glazing, it is advantageous to cut the sheet just prior to assembly with the other components of the glazing; in this case the support 1 can be made part of a conveyor engaging the sheet in the laminated glazing production line. Beneath the sheet 4 and the two parts 2 and 3 of the support, a blade carrier 5 that can be made by assembling two metal plates 6 and 7, supports a blade 8 made of thin stainless steel having a thickness, for example, of about few tenths of a mm.

The blade carrier 5 and the blade 8 are transversally positioned with respect to the direction of movement of the sheet, and they extend beyond the side edges of the sheet. The blade carrier and the blade can be raised so that the blade uplifts the sheet. To provide this action the blade carrier can be slideably mounted on vertical rods, not shown, disposed on parts of the support structure. The blade carrier can also be pivotally mounted about an axis positioned on the frame above the sheet. Above the support 1 of the sheet, the upper part of the device comprises two clamps 9 and 10 that extend the length of the blade and are fixed together, being mounted onto a metal plate 11. The sides of the two clamps facing each other have extended lower rounded sections 12 and 13 so that their upper sections form a groove 14 for receiving a heating element. The heating element can be an electrical resistor 15 enclosed in a silica tube 16 having an exterior diameter of about 5 mm. The electrical resistor extends the length of the clamps and is connected to an electrical power source not shown, which for safety reasons, supplies low voltage electrical power to the resistor. The amperage is high, for example on the order of 20 amps.

The two clamps are connected to each other by the metal plate 11 in a way so that their separation is equal to or slightly greater than the sum of the thickness of the blade and twice the thickness of the sheet to be cut.

The two clamps and the heating element are fixed together and form an assembly that can be mounted on vertical rods, not shown, on each side of the sheet; the assembly can be displaced for the cutting operation during the vertical movement of the sheet.

Figure 2:
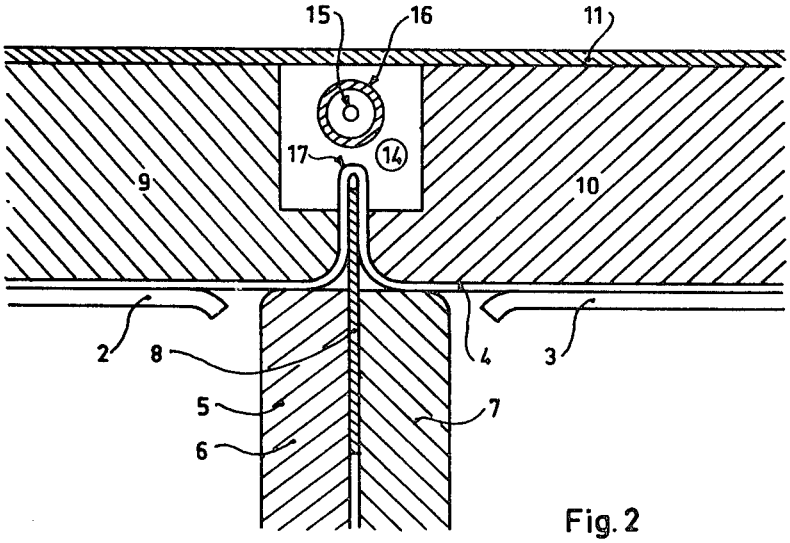
FIG. 2 shows the device of FIG. 1 in the cutting position.

FIG. 2 shows the previously-described device in the cutting position. The blade carrier and the blade 8 have been lifted and the blade is at a raised position relative to the support 1, for example about 7 mm above it. The upper portion of the device has been lowered and the two clamps 9 and 10 enclose the sheet 4 to form a fold 17. In this cutting position, the heating element is located facing the fold and at a distance on the order of several mm. The fold 17 also has no contact with the blade 8.

The function of the previously-described device is as follows:

The sheet 4 is positioned on the support 1. The blade carrier and the blade 8, which lifts the sheet several mm with respect to the level of the support 1, are raised. The upper portion of the device is lowered. The clamps come into contact with the sheet at their rounded sections 12 and 13, said sections being smooth to eliminate deterioration of the sheet. In descending, the clamps apply the sheet 4 against the blade 8 and the blade forms a fold 17 on the sheet. At the end of descent, the upper portion of the fold is situated several mm from the heating resistor and the lower portion generally does not touch the blade 8.

The resistor is supplied with electrical power. The high amperage causes the resistor to heat rapidly and significantly. Its temperature reaches about 500° C. The heat radiates toward the fold. Under the action of the heat, the strength of the sheet of plastic material diminishes, and the sheet ruptures along the line of the fold.

Figure 3:
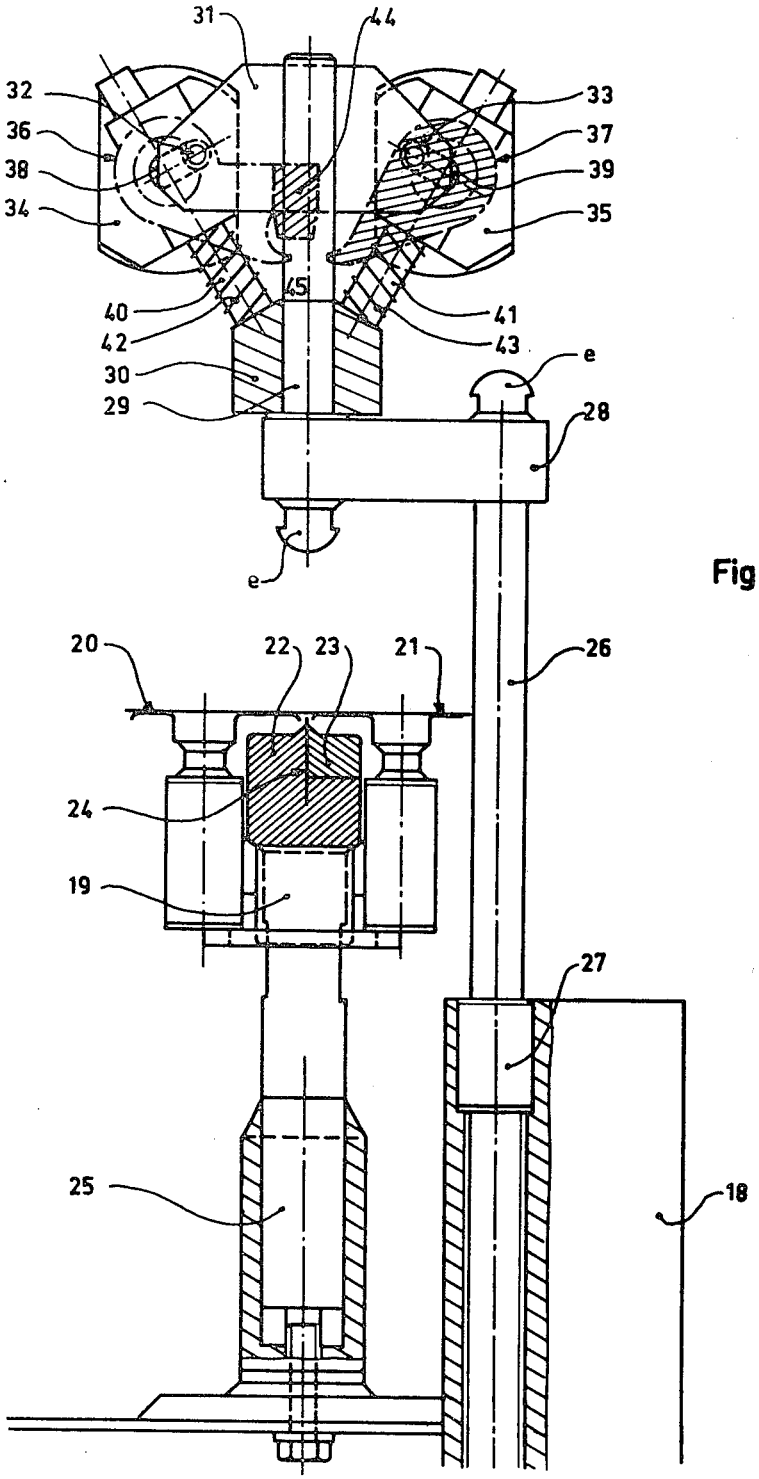
FIG. 3 shows another form of the device, in a view perpendicular to the cutting line.

FIG. 3 shows a variation of the device, which has several advantages, and in which the two clamps advance toward each other during their descent. On the one hand, such a device is suitable for cutting sheets that differ greatly from each other in thickness. On the other hand, the advance movement of the clamps according to an oblique line with respect to the blade causes the sheet to wrap around the blade and limits friction, and therefore the damage to the sheet along the cutting line.

In this form, the cutting device has a frame 18 on which lies an assembly 19 extending the width of the device, and which comprises the support for the sheet formed from two plates 20 and 21, as well as a blade carrier formed in two parts 22 and 23 that supports a metal blade 24. The vertical position of assembly 23 is regulatable by means of a screw jack 25. On each side of the device, a vertical rod 26, mounted on the frame by bearings 27, is fixed to a transverse bar that connects the two rods, the transverse bar being connected to the rod of a vertical jack (not shown), to be actuated in an up-and-down movement. The upper portion of each rod 26 carries a support 28 on which a vertical post 29 is mounted. A block 30 is slideably mounted by means of a bearing (not shown) on post 29. The rods 26 and the post 29 are fastened to the supports 28 with, for example, screw nuts e. Fixed on the vertical post 29 by means of a screw, for example, is a metal plate 31 that bears two rollers 32 and 33 at spaced locations on the plate. Two blocks 34 and 35 are fixed, by appropriate means on the ends of the clamps 36 and 37 and are positioned on different parts of the metal plate 31 and have slots 38 and 39 for receiving the rollers 32 and 33 respectively. The blocks 34 and 35 are mounted by bearings on inclined axes 40 and 41 and can slide on them. The two axes are inclined about 60° to each other and are mounted on the block 30. Two springs 42 and 43 mounted around the two oblique axes 40 and 41, maintain separation between the block 30 and the two blocks 34 and 35. On one of the clamps is fixed, by means of screw 101 (FIG. 4), for example, a heating assembly comprising a resistor support 44 and a heating resistor 45 which will be described later.

Figure 4:
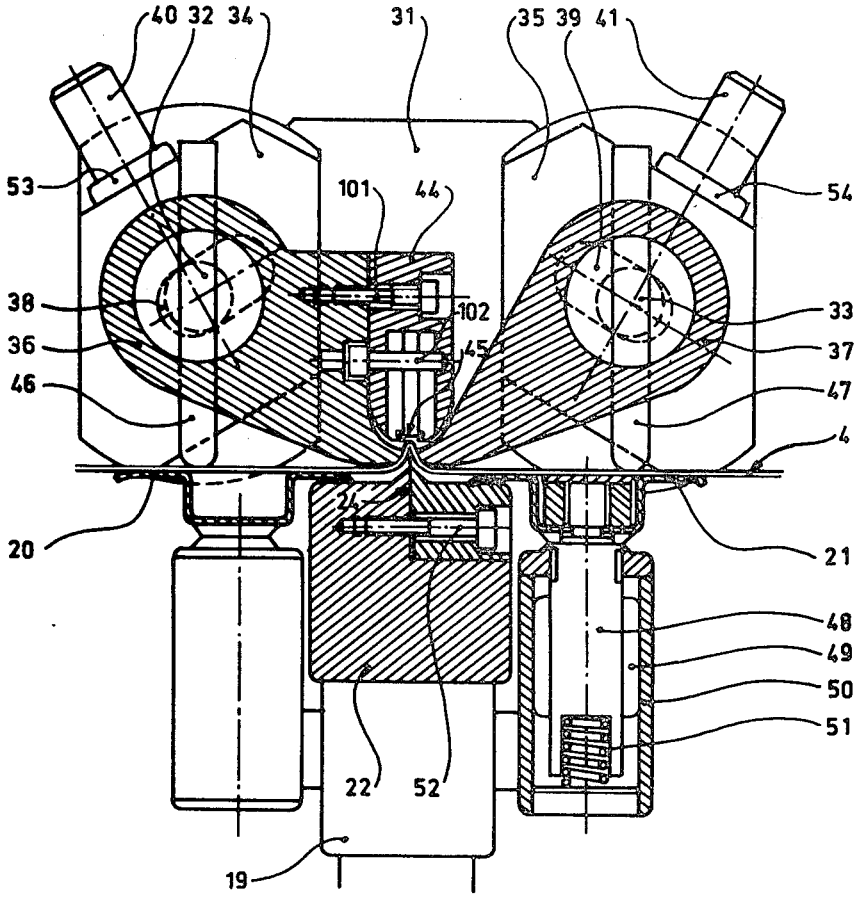
FIG. 4 represents the device of FIG. 3 in the cutting position.

FIG. 4 shows the FIG. 3 form of the device in the cutting position. The two clamps 36 and 37 carry at their ends fingers 46 and 47 that have come to rest on the plates 20 and 21. Each of these plates is mounted on the upper end of a pin 48 that slides in bearings 49 in the support 50 that is a part of the assembly 19; the lower end of the pin 48 rests on the spring 51. The action of the fingers 46 and 47 on the plates causes a compression of the springs 51 and causes the plates to be lowered. In the cutting position, the metal blade, that is maintained between the two parts joined by screw 52 of the blade carrier, extends above the plates. The sheet is enclosed between the two clamps 36 and 27 that, by the blocks 33 and 34, mounted on bearings 53 and 54, are displaced as will be described, on the inclined axes 40 and 41, and along the rollers 32 and 33 by the action of the slots 38 and 39.

Figure 5:
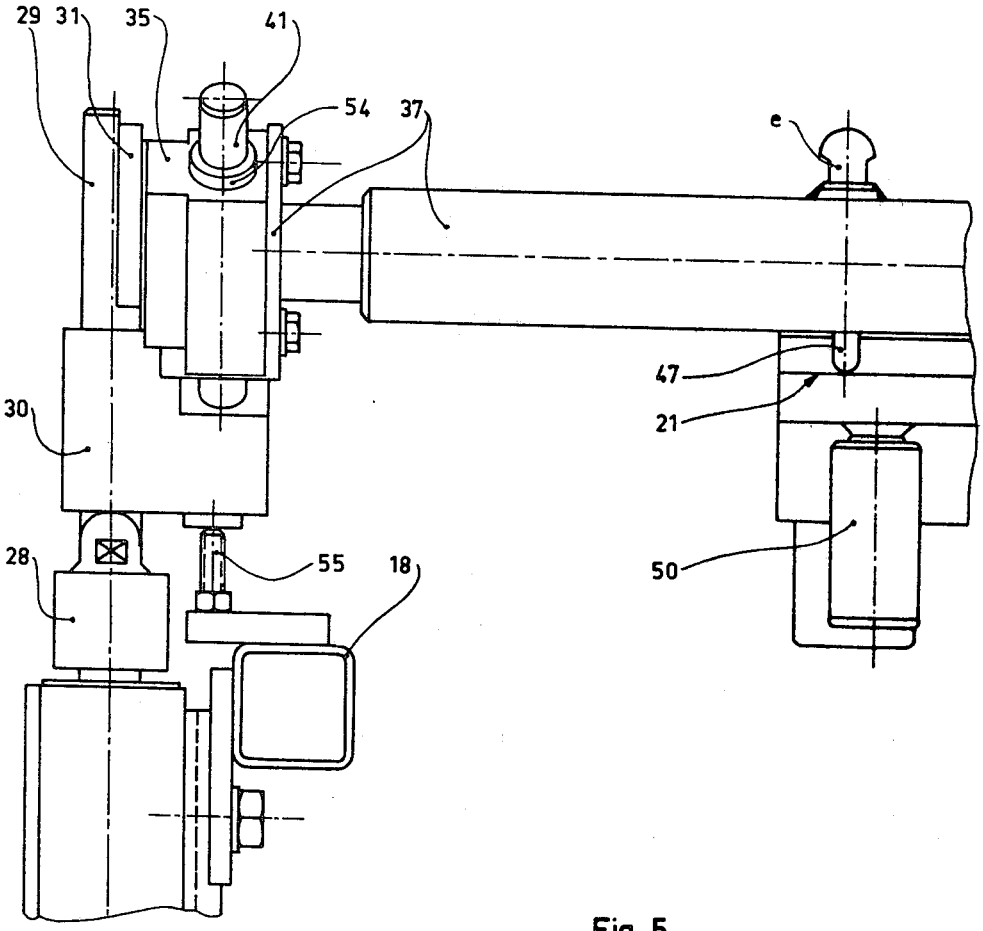
FIG. 5 shows the FIG. 3 form of apparatus in an elevational view.

FIG. 5 shows the FIG. 3 form of the device in a partial elevational view. On the post or axis 29 mounted on the support 28 slides the block 30. A rod 55, mounted on the frame at each side of the device, serves as a stop for the block 30 in its vertical path. The block 35 is fixed to the clamp 37, and slides the length of the oblique axis 41. The finger 47 carried by the clamp engages the plate 21.

Figure 6:
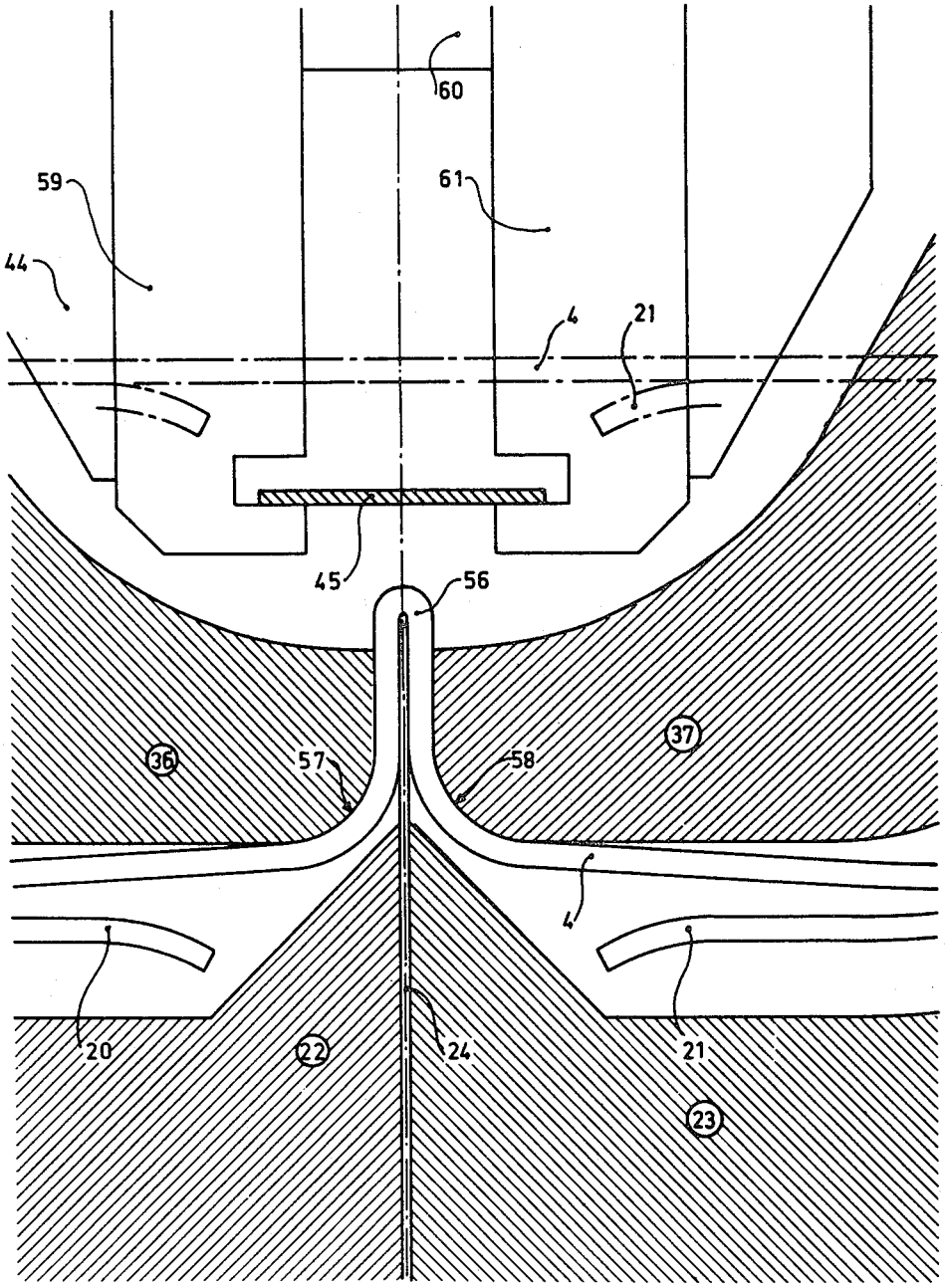
FIG. 6 shows a detailed view of a portion of the apparatus of FIG. 4.

FIG. 6 shows a detail view of a cutting zone of the above-described form of the device. The sheet is enclosed between the two clamps 36 and 37 about the blade 24 to form a fold 56. The active portions 57 and 58 of the clamps are perfectly smooth and have a curvature free from all roughness to avoid defacement of the sheet. The curvature of the clamps, associated with a 60° approach movement of the said clamps, limits the friction between the sheet and the blade along the entire blade.

The rigid blade 24 is preferably of stainless steel and has a thickness on the order of 0.2 mm. The blade is held in a blade support that has an upper central part in the form of a V. On each side of the central portion of the support, plates 20 and 21 support the sheet 4. Above the fold of the sheet, the heating element is a flat horizontal metal blade 45 made of a nickel chromium alloy, approximately 5 mm wide, with a thickness of several tenths of a mm. The heating blade 45 is supplied with a low voltage and high amperage electrical current, for example on the order of 20 amps. The heating blade is held in the blade support of which three parts 59, 60 and 61 held together by screws 102 are of a thermal and electrical insulating material, for example a ceramic such as steatite or quartz. Each of the parts of the blade support comprises a succession of small plates. The heating blade overlies portions of the parts 59 and 61, lengthwise along the blade support and is free to expand by the action of the heat while staying at a constant distance from the fold of the sheet. In the cutting position, the heating blade is located approximately 1 mm from the fold. The lower portion of the fold does not touch the rigid blade 24.

The operation of the FIG. 3 form of the device is as follows. The sheet 4, is brought by a conveyor and lies on the plates 20 and 21. The jack that controls movement of column 26 is then actuated, said jack controlling the descent of the entire upper portion of the device that comprises the two clamps. Upon contact with the stop rod 55 (FIG. 5), the block 30 is stopped at the same time as the two oblique axes 40 and 41, which are on the block. The other elements continue their descent.

As the part 31 continues its descent, the two blocks 34 and 35 slide, along the oblique axes 40 and 41 and are displaced inwardly by reason of the slideably engagement of rollers 32 and 33 with the slots 38 and 39 of the blocks, meanwhile compressing the two springs 42 and 43. The two clamps 36 and 37 fixed to the blocks continue the same forward movement. The fingers 46 and 47 carried by the clamps come into contact with the plates and the plates are lowered by compression of the springs 51, which reveals the blade 24. Thus the blade supports the sheet. During their movement toward the blade, the two clamps act on the sheet to make it fold about the blade. The action of the clamps at a 60° incline produces a very good fold of the sheet. When the jack arrives at the end of its travel, the two clamps enclose the sheet which is subjected, along the fold formed, to uniform stress, confined within a very narrow zone. The the electrical resistor is supplied with high amperage electrical current, that causes the resistor to be very rapidly heated to about 500° C. The heat radiates toward the fold and the sheet ruptures along it. The jack is then acutated in the other direction. From the two sides of the device, the vertical rod 26 is raised, carrying with it the post 29 and the two blocks 35 and 34 by the action of the two rollers. The two springs extend and the clamps open up just until the rollers attain the upper ends of the slots of the blocks. Then, the entire upper portion of the device is raised.

The total duration of the operation is on the order of eight seconds.

When the sheet is formed of two layers of polyurethane one being a thermosetting polyurethane while the other being a thermoplastic polyurethane, for the reasons already given, the sheet is oriented with the thermoplastic side toward the heating resistor, that is, toward the top in this example. For example, the cutting of the sheet in which the layers of thermosetting polyurethane and thermoplastic polyurethane are approximately 0.5 mm and 0.02 mm thick respectively is easily effected.

Devices defining only one cutting line have been previously described. Preferably, as has been already stated, for reasons of cutting rate, it is often desirable to effect a simultaneous double cut or two successive cuts without changing the position of the sheet.

Figure 7:
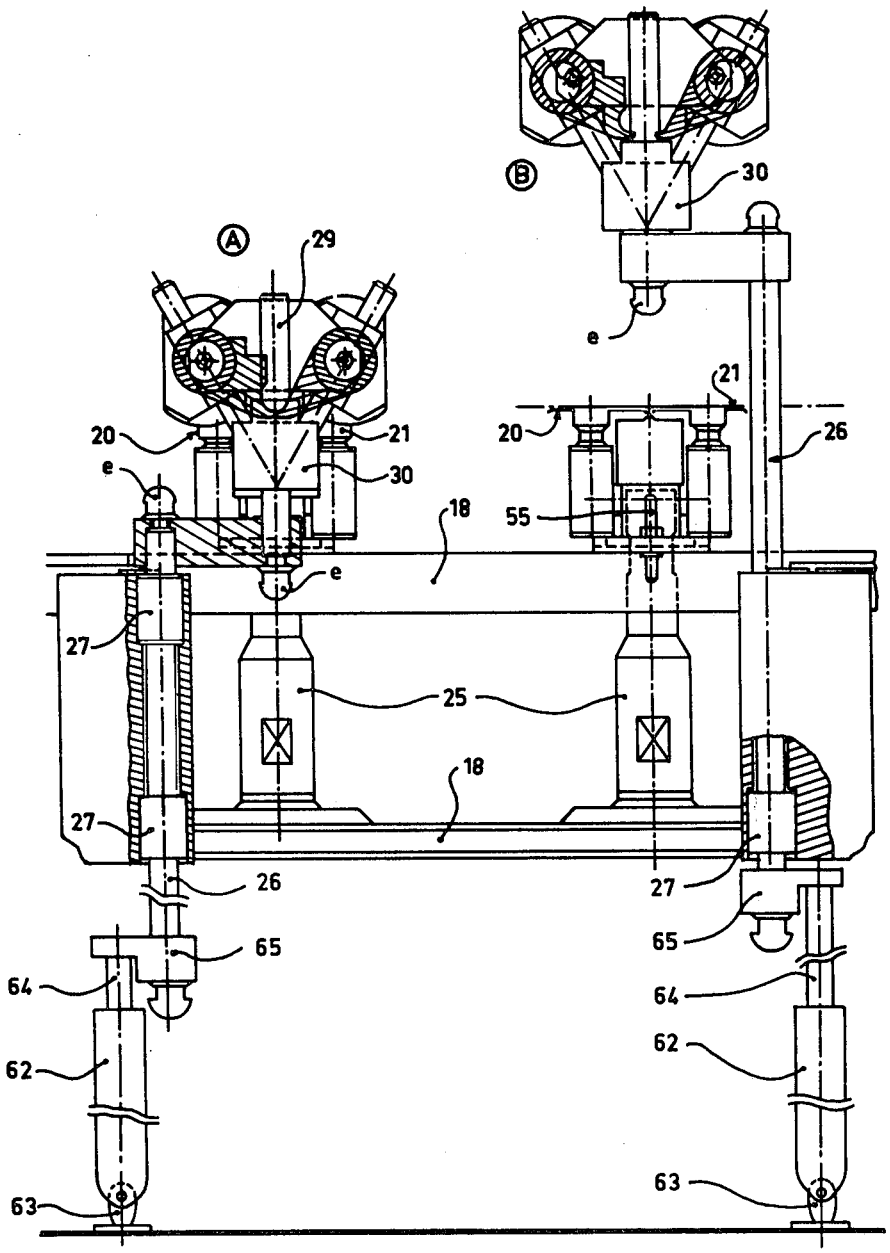
FIG. 7 shows a third form of the apparatus.

FIG. 7 shows a variation of the cutting device that comprises two cutting assemblies A and B, identical to those already described and which enable the double cut.

On this figure, the device is shown with cutting assembly A in the cutting position, while the other assembly B is in the rest position. The two cutting assemblies are separated by a distance of approximately 250 mm. The two cutting assemblies can be utilized simultaneously or one after the other. The upper parts of assemblies A and B are actuated by rods 26 regulated by vertical jacks 62, fastened to the bed by means of ball and socket joints 63. The rod 64 of each jack is fastened to the middle of the transverse bars 65 which extends the entire width of the device and on which the rods 26 are fastened. The jacks are, for example hydraulic jacks marketed under the name Verin C Nomo by Climax-France. In the assembly in the rest position, the plates are in the upper position at a higher level that that of the blade, while in the assembly in the cutting position, the plates are lowered by means previously described.

A device according to the invention could comprise more than two cutting assemblies.

Other variations of the device are possible. For example, one could make the device with clamps that are advanced toward the sheet directly by inclined jacks.

In the same way one could realize a device according to the invention suitable for use in cutting a continuous ribbon of plastic material. To do this it would suffice to replace the metal blade around which the fold is made, with a succession of rollers in the form of disks, and the clamps could comprise, for example a series of rollers between which would be disposed a heating element, the axes of the clamping rollers being advantageously inclined at 60° C. for example.

The device according to the invention can also be suitable for making curved cuts. In this case, the device comprises clamps, a blade and a heating element which conform to the desired curve.

The cutting in accordance with the invention can be applied to a large variety of single-layered or composite sheets or films of plastic material. These sheets, however, must be flexible enough to undergo stress, such as that needed for folding.

Generally, in order to obtain a good cutting of the sheet, the greater the elongation and/or stress at rupture of the plastic material of which the sheet is comprised, the greater must be the stress on the sheet and/or the higher must be the temperature imposed on the stress zone. It is assumed that the temperature of this zone must have a value such that it promotes a diminution of the mechanical property of stress at rupture of the plastic material, a temperature that reduces the strength of the material to a value at least equal to the stress imposed on the sheet.

The sheets of plastic material, suitable for cutting in accordance with the process and the device of the invention, can have different thicknesses, from a few tenths of a mm to less than a few mm. The cutting is so much cleaner and easier because the resistance to propagation of rupture in the thickness of the plastic material is lower; this resistance diminishes greatly by elevating the temperature.

We claim:

1. A method for cutting a sheet formed of at least one layer of plastic material, comprising folding the sheet to create a stress line in the sheet, and disposing the folded sheet to present the stress line to a heat source spaced therefrom, and heating the stress line without contact thereof with the heat source until the sheet ruptures along the stress line.

2. The method as claimed in claim 1 wherein the sheet is folded 180°.

3. The method as claimed in claim 1 wherein the stress line is heated by radiation from a heat source situated a short distance from the stress line.

4. The method as claimed in claim 1 wherein the sheet is cut simultaneously along more than one line.

5. The method as claimed in claim 1 wherein the sheet of plastic material is suitable for use in laminated glazings and has satisfactory optical qualities for this purpose.

6. A method for cutting a sheet formed of at least two layers of plastic material, one of the layers having properties of stress and elongation at rupture higher than those of another layer, said method comprising, forming a confined stress line in the sheet in a manner imparting a greater stress to the layer of which the stress and/or elongation at rupture is greater, and heating the stress line by means of a heat source spaced therefrom until the sheet ruptures along the stress line.

7. The method as claimed in claim 6 wherein at least one of the layers of plastic material comprises a thermosetting polyurethane.

8. The method as claimed in claim 6 wherein one of the layers comprises a thermosetting polyurethane and another comprises a thermoplastic polyurethane.

9. The method as claimed in claim 6 wherein said confined stress line is created by folding said sheet.

10. The method as claimed in claim 9 wherein the sheet is folded 180°.

11. Cutting apparatus for cutting a sheet formed of at least one layer of plastic material comprising a thin rigid blade, means for creating stress on a small zone of the sheet by folding the sheet about the blade, and heating means disposed in spaced relation to said stress zone for selectively applying heat to said zone.

12. Apparatus according to claim 11 wherein the means for creating stress on a small zone of the sheet by folding it around the blade comprise two movable clamps.

13. Apparatus as in claim 12 wherein the two clamps slide on inclined axes to approach each other as they approach the blade.

14. Apparatus as in claim 13 wherein the axes on which the clamps slide are inclined at 60° in relation to each other.

15. Apparatus as in claim 12 wherein the clamps form a groove for receiving the heating means.

16. Apparatus as in claim 12 wherein the heating means are integral with the clamp.

17. Apparatus as in claim 11 wherein the heating means comprises a resistor in the form of a horizontal thin blade held on its entire length by a thermally and electrically insulating support.

18. Apparatus as in claim 17 wherein the resistor is a stainless steel blade.

19. Apparatus as in claim 17 or 18 wherein the support of the resistor blade is made up of a series of thin plates.

20. Apparatus as in claim 17 wherein the support comprises thin quartz plates.

21. Apparatus as in claim 17 wherein the resistor is supplied with a high amperage electrical current.

22. Apparatus as in claim 11 in which the clamps form between themselves an enclosure containing the heating means.

23. A method for cutting a sheet formed of at least one layer of plastic material, comprising, creating stress in the sheet by folding the sheet through 180° so as to elongate the sheet in the folded zone, and heating the folded zone without contact therewith by the heating means until the stress at rupture of the plastic material reaches the stress value imparted to the sheet by the elongation.

* * * * *